US009021802B2

(12) United States Patent
Petitjean et al.

(10) Patent No.: US 9,021,802 B2
(45) Date of Patent: May 5, 2015

(54) TURBINE HOUSING ASSEMBLY WITH WASTEGATE

(75) Inventors: Dominique Petitjean, Julienrupt (FR); Guillaume Dupont, Thaon les Vosges (FR); Anthony Ruquart, Epinal (FR); Philippe Arnold, Hennecourt (FR); Manimurugan Palaniyappan, Zlin (CZ); Manuel Marques, Flavigny sur Moselle (FR); Jean-Jacques Laissus, Morristown, NJ (US); Raphael Ceotto, Morristown, NJ (US)

(73) Assignee: Honeywell International Inc., Morristown, NJ (US)

( * ) Notice: Subject to any disclaimer, the term of this patent is extended or adjusted under 35 U.S.C. 154(b) by 1074 days.

(21) Appl. No.: 12/869,343

(22) Filed: Aug. 26, 2010

(65) Prior Publication Data

US 2012/0047887 A1 Mar. 1, 2012

(51) Int. Cl.

| | |
|---|---|
| ***F02D 23/00*** | (2006.01) |
| ***F01D 9/02*** | (2006.01) |
| ***F01D 17/10*** | (2006.01) |
| ***F01D 21/04*** | (2006.01) |
| ***F01D 25/24*** | (2006.01) |

(52) U.S. Cl.

CPC ..... *F01D 9/026* (2013.01); *F01D 17/105* (2013.01); *F01D 21/045* (2013.01); *F01D 25/24* (2013.01); *F05D 2230/21* (2013.01); *F05D 2230/232* (2013.01); *F05D 2220/40* (2013.01)

(58) Field of Classification Search

CPC ..... F01D 9/026; F01D 17/105; F01D 21/045; F01D 25/24; F05D 2230/232; F05D 2220/40; F05D 2230/21

USPC ..... 60/602, 605.1; 251/298, 210, 306, 297, 251/332–333

See application file for complete search history.

(56) References Cited

U.S. PATENT DOCUMENTS

| | | | | |
|---|---|---|---|---|
| 4,245,953 | A * | 1/1981 | Milton et al. | 415/144 |
| 4,274,436 | A * | 6/1981 | Smith | 137/515.7 |
| 4,613,288 | A * | 9/1986 | McInerney | 417/407 |
| 4,655,043 | A * | 4/1987 | McInerney | 60/602 |

(Continued)

FOREIGN PATENT DOCUMENTS

| | | | |
|---|---|---|---|
| EP | 834646 | A1 | 4/1998 |
| JP | 2003035153 | A | 2/2003 |

(Continued)

*Primary Examiner* — Kenneth Bomberg
*Assistant Examiner* — Paolo Isada
(74) *Attorney, Agent, or Firm* — Brian J. Pangrle

(57) ABSTRACT

An assembly includes a cast cartridge component that includes a base plate having an opening configured for receipt of a turbine wheel, a cylindrical wall that comprises a shroud portion, one or more supports disposed between the cylindrical wall and the base plate, an exhaust conduit that has an inlet, an outlet and a wastegate opening positioned intermediate the inlet and the outlet, and a substantially planar surface integral to the exhaust conduit, the wastegate opening located on the planar surface; and a wastegate outlet component that includes a cylindrical portion that extends between and defines an inlet and an outlet, and a cover portion configured to cover the substantially planar surface of the cast cartridge component to form a wastegate chamber where one or more openings provide for flow of exhaust from the wastegate chamber to the cylindrical portion. Various other examples of devices, assemblies, systems, methods, etc., are also disclosed.

20 Claims, 17 Drawing Sheets

(56) References Cited

U.S. PATENT DOCUMENTS

| | | | | |
|---|---|---|---|---|
| 4,730,456 | A * | 3/1988 | Tadokoro et al. | 60/602 |
| 6,951,450 | B1 | 10/2005 | Figura et al. | |
| 8,028,525 | B2 * | 10/2011 | An et al. | 60/612 |
| 8,205,448 | B2 * | 6/2012 | Koch et al. | 60/602 |
| 2003/0159442 | A1 * | 8/2003 | Huter et al. | 60/612 |
| 2007/0101715 | A1 * | 5/2007 | Martin et al. | 60/605.1 |
| 2008/0298953 | A1 * | 12/2008 | Harris | 415/144 |
| 2009/0031722 | A1 * | 2/2009 | An et al. | 60/600 |

FOREIGN PATENT DOCUMENTS

| | | | |
|---|---|---|---|
| JP | 3489332 | B2 | 1/2004 |
| WO | 2009031940 | A1 | 8/2009 |

* cited by examiner

TURBINE HOUSING ASSEMBLY WITH WASTEGATE

RELATED APPLICATION

This patent application is related to, and incorporates by reference herein, U.S. patent application entitled "Turbine housing assembly" having Ser. No. 12/869,307, which was filed on Aug. 26, 2010.

TECHNICAL FIELD

Subject matter disclosed herein relates generally to turbomachinery for internal combustion engines and, in particular, to turbine housings.

BACKGROUND

Many conventional turbine systems require separate wastegate features such as valves and conduits. Accordingly, engine environment or compartment design must account for the turbine system as well as the separate wastegate valve(s) and conduit(s). The disaggregated nature of such components complicates design, especially when one or more additional exhaust conduits are required because consequences of heat carried by exhaust flowing in one or more additional conduit must be considered as well (e.g., additional insulation of conduits, other engine components and reduction of usable engine compartment space). Various turbine housing assemblies with integral wastegate features are presented herein that provide advantages when compared to conventional turbine systems that require separate wastegate features.

BRIEF DESCRIPTION OF THE DRAWINGS

A more complete understanding of the various methods, devices, assemblies, systems, arrangements, etc., described herein, and equivalents thereof, may be had by reference to the following detailed description when taken in conjunction with examples shown in the accompanying drawings where.

DETAILED DESCRIPTION

Figure 1:
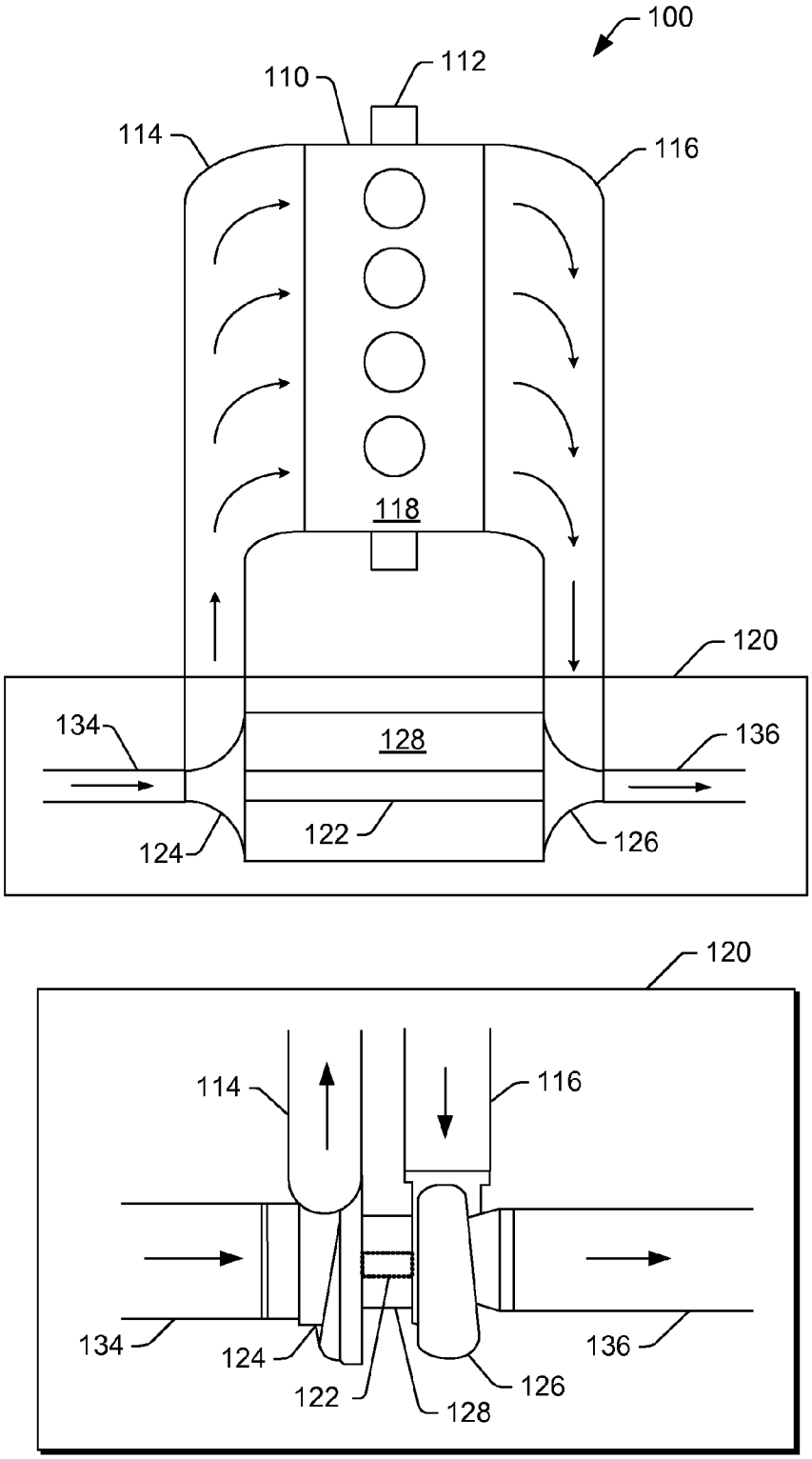
FIG. 1 is a diagram of a turbocharger and an internal combustion engine.

Turbochargers are frequently utilized to increase output of an internal combustion engine. Referring to FIG. 1, a conventional system 100 includes an internal combustion engine 110 and a turbocharger 120. The internal combustion engine 110 includes an engine block 118 housing one or more combustion chambers that operatively drive a shaft 112. As shown in FIG. 1, an intake port 114 provides a flow path for air to the engine block 118 while an exhaust port 116 provides a flow path for exhaust from the engine block 118.

The turbocharger 120 acts to extract energy from the exhaust and to provide energy to intake air, which may be combined with fuel to form combustion gas. As shown in FIG. 1, the turbocharger 120 includes an air inlet 134, a shaft 122, a compressor 124, a turbine 126, a housing 128 and an exhaust outlet 136. The housing 128 may be referred to as a center housing as it is disposed between the compressor 124 and the turbine 126. The shaft 122 may be a shaft assembly that includes a variety of components.

Figure 2:
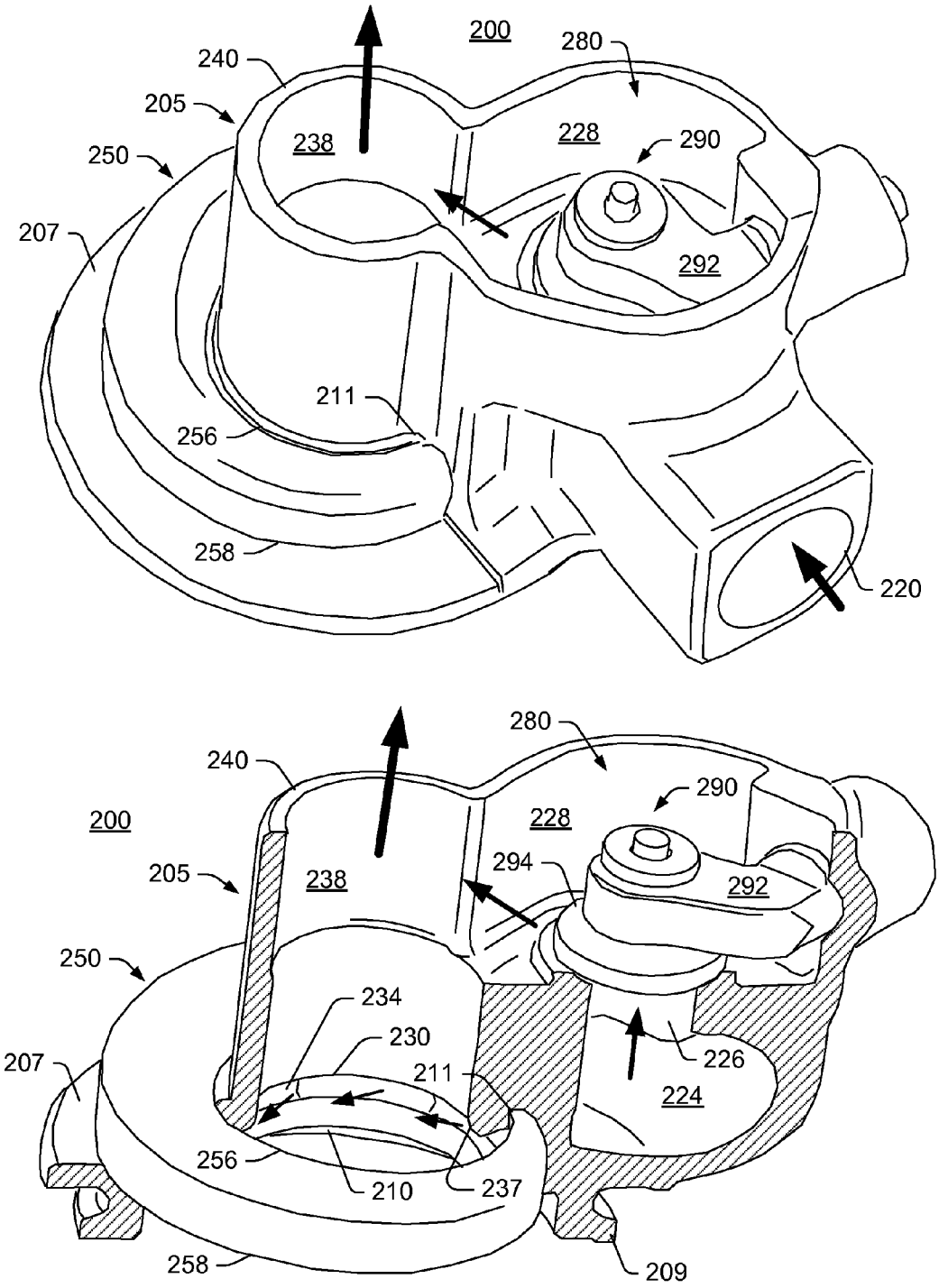
FIG. 2 is a perspective view and a cross-sectional view of an example of a turbine housing and wastegate assembly.

FIG. 2 shows a perspective view and a cross-sectional view of an example of a turbine housing assembly 200 that includes a cartridge component 205 and a volute component 250 along with a wastegate control valve 290 with a control arm 292 for positioning a plug 294. In the example of FIG. 2, the cartridge component 205 forms, at least in part, a wastegate chamber 280. The cartridge component 205 includes an upper surface 207, a mount portion 209, an opening 210 configured for receipt of a turbine wheel and supports 234 that extend from the upper surface 207 and support a cylindrical wall 238 that has a contoured shroud portion 237. The cylindrical wall 238 extends to another substantially cylindrical wall 228 that defines, at least in part, the wastegate chamber 280.

As shown in FIG. 2, the cartridge component 205 includes an inlet 220 that provides exhaust to a conduit 224 formed by the cartridge component 205. The conduit 224 includes an opening 226 that provides for passage of exhaust from the conduit 224 to the chamber 280. Regulation of exhaust from the conduit 224 to the chamber 280 occurs via the wastegate control mechanism 290, which includes a plug 294 configured to plug the opening 226. The plug 294 is operably connected to a control arm 292 such that movement of the control arm 292 (e.g., via an actuator) can partially or fully open the opening 226 (i.e., for "waste gating" exhaust).

As described herein, a cartridge component may be a single cast piece with or without one or more voids. For example, the cartridge 205 may be a single cast piece that includes the supports 234 and the walls 228 and 238 without or with voids (e.g., where voids may act to reduce weight, control heat transfer, etc.).

In the example of FIG. 2, the volute component 250 is a curved wall that includes an upper edge 256 and a lower edge 258. The upper edge 256 abuts the cylindrical wall 238 while the lower edge 258 abuts the upper surface 207 of the cartridge component 205. The upper edge 256 of the volute component 250 generally includes at least a portion with an arcuate shape (e.g., matched to abut the cylindrical wall 238). At one end, the volute component 250 abuts an arched wall 211 of the cartridge component 205, for example, that may define an opening to allow for exhaust to reach a turbine wheel from 360 degrees or approximately 360 degrees. Accordingly, in such an arrangement, the cartridge component 205 and the volute component 250 form a volute that can receive exhaust and provide exhaust to a turbine wheel space. Further, the wastegate control mechanism 290 can control how much exhaust entering the assembly via the inlet 220 is directed to the turbine wheel space.

As described herein, a cast component can provide a durable shroud or wheel contour (see, e.g., shroud 237). Further, where the cartridge component 205 is cast, it can provide some degree of burst containment. Specifically, in the example of FIG. 2, where the cartridge component 205 is cast, upon burst of a turbine wheel, various features of the cartridge component 205, if remaining intact (e.g. material defining the opening 210, the supports 234 and the cylindrical wall 238), can help contain and absorb energy from debris, leaving only the spaces between the supports 234 and an opening 240 defined by the cylindrical wall 238 as possible ejection pathways.

Where the cartridge component 205 is cast, it can also provide support for attachment to of the turbine housing assembly 200 to a bearing housing (e.g., a turbocharger center housing), for example, via a V-band fixation mechanism as shown in FIG. 2 (see, e.g., mount portion 209) or other fixation mechanism.

As described herein, a cast cartridge component can include a V-band for fixation and a wheel contour. Such a cartridge component can provide various benefits and allow for use of various types of volute components and outlet components. For example, a volute component may be tailored to provide particular operational characteristics. Specifically, a volute component may be shaped for a particular volute volume, cross-sectional area, cross-sectional shape, etc. Use of a separate volute component can also allow for flow surface modification, for example, polishing, indicia to direct flow, etc. Such parameters may provide for reduced frictional losses and improved flow fields as well as tailoring exhaust flow to a turbine wheel or matching a volute component to a particular turbine wheel or family of turbine wheels, optionally for certain operational conditions (e.g., low load, high load, etc.).

As described herein, a turbine housing assembly with a cast cartridge component, such as in the assembly 200, can reduce mass and retention of heat in comparison to an assembly where the volute is also cast. For example, a conventional cast turbine housing with an integral cast volute typically requires more material, contains more mass and will retain more heat. In comparison, where a volute component, such as the volute component 250, can be made of a material that has a lesser mass, lesser thickness, lesser heat capacity, etc., which may be expected to retain less heat. Further, casting may be simplified for a cartridge component compared to a cast turbine housing with an integral volute. Further, cleaning and examination of features of a cast cartridge may be performed more readily compared to a cast volute where a special tool or tools may be required to clean a cast or examine cast quality (e.g., inner surface of the volute). As described herein, a volute component may be formed from sheet metal, a light-weight high temperature composite material (e.g., ceramic matrix composites), or other material.

Figure 3:
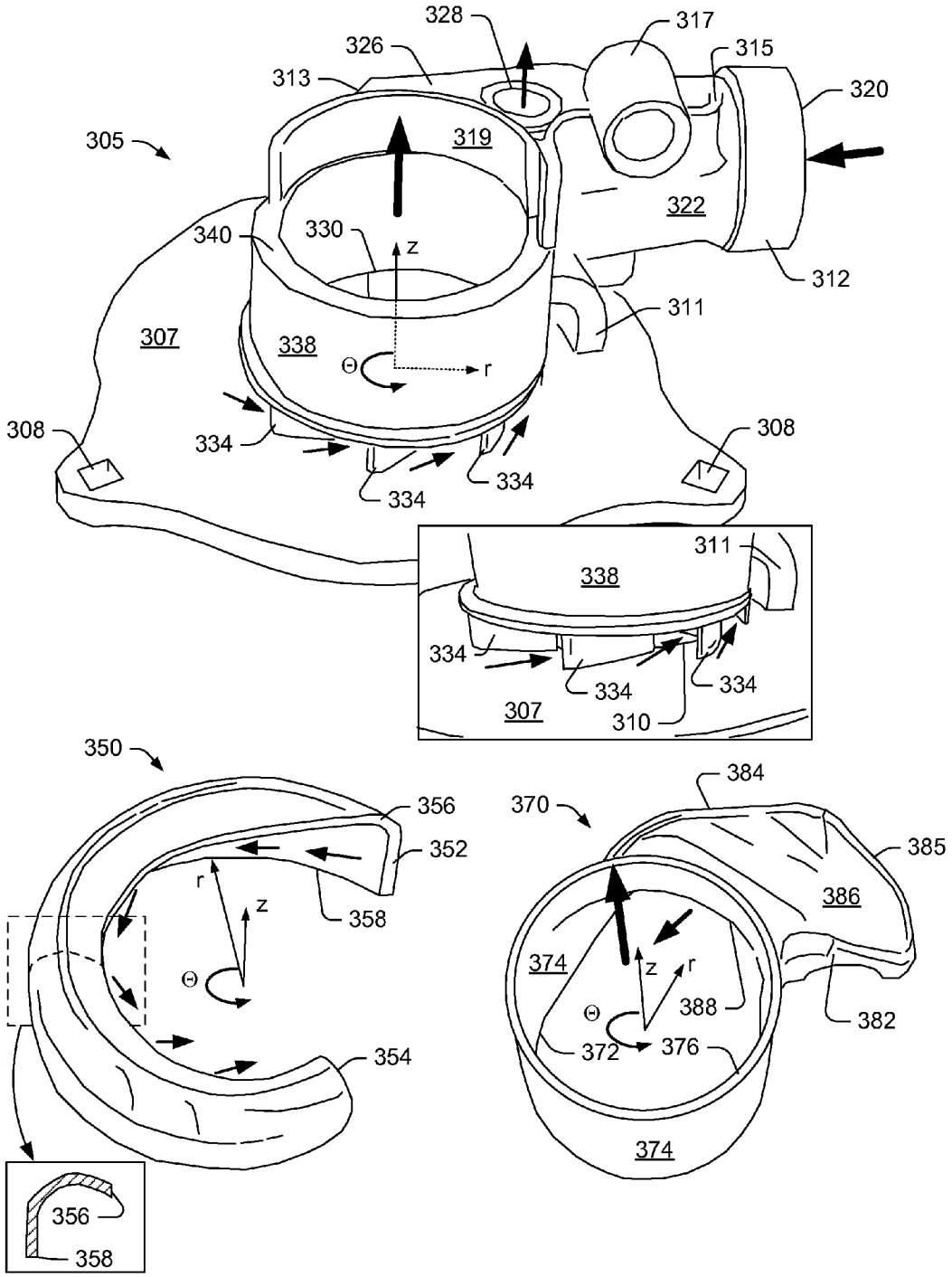
FIG. 3 is a series of perspective views of components of an example of a turbine housing and wastegate assembly.

FIG. 3 shows an example of a turbine housing assembly 300 that includes a cartridge component 305, a volute component 350 and a wastegate outlet component 370. The components 305, 350 and 370 are shown in FIG. 3 with respect to a cylindrical coordinate system having an axial "z" coordinate, a radial "r" coordinate and an azimuthal "Θ" coordinate (see, e.g., Beyer, W. H., *CRC Standard Mathematical Tables,* 28th ed. Boca Raton, Fla.: CRC Press, p. 212, 1987).

The cartridge component 305 is configured to receive exhaust via an inlet 320 of an exhaust conduit 322, where the exhaust conduit 322 may be cast integral to the base plate 307. The exhaust conduit 322 has a fitting 312, a rib 315 that supports a fixture 317 for a wastegate valve, and a planar surface 326 with a wastegate opening 328 for "waste gating" exhaust (e.g., diverting exhaust away from a path to a turbine). In the example of FIG. 3, the rib 315 extends to a raised arcuate wall 319 and supports the fixture 317, which is a cylinder with a central bore for receipt of a wastegate valve control shaft.

The base plate 307 may include openings 308 for receipt of rods, bolts, or other components for mounting or fixation of the turbine hosing assembly 300 where the openings 308 are positioned near a maximal radial dimension of the base plate 307. As seen in an enlarged view, the base plate 307 includes an opening 310 configured for receipt of a turbine wheel. The opening 310 may be defined by a radial dimension slightly larger than a radius of a turbine wheel.

In the example of FIG. 3, the cartridge component 305 further includes a cylindrical wall 338 with an outlet 340 and vanes 334 disposed between the cylindrical wall 338 and the base plate 307 where adjacent vanes 334 define throats. At trailing edges of the vanes 334, the throats open at a gap 330. An axial height of the gap 330 may be defined by an axial dimension of one or more of the vanes 334. Different vanes 334 may differ in axial height and therefore result in a varying height for the gap 330 (e.g., an axial dimension for the gap 330 that varies about the angle Θ). Each of the vanes 334 may be defined via a line passing between a trailing edge and a leading edge where the line forms a vane angle, for example, an angle defined with respect to a radial line extending from the z-axis to the vane's trailing edge. In general, the vanes 334 are fixed (e.g., formed at a fixed vane angle). Each vane may have a particular shape that differs from one or more other vanes, for example, where the shape of a vane depends on position of the vane about the azimuthal angle. In various examples, all vanes may have the same shape, the same height and the same vane angle.

In the example of FIG. 3, the volute component 350 is a curved wall that curves about the azimuthal dimension and that includes a proximal end 352 and a distal end 354 and an upper edge 356 and a lower edge 358. As shown in a cross-sectional view for a specific angle Θ, the volute component 350 has a particular shape; noting that the cross-sectional shape of the volute component 350 varies with respect to the angle Θ. As described herein, the cross-sectional shape of the volute component 350 may be tailored to achieve one or more goals.

Upon assembly of the cartridge component 305 and the volute component 350, the upper edge 356 abuts the cylindrical wall 338 while the lower edge 358 abuts the upper surface 307 of the cartridge component 305. Further, the proximal end 352 abuts an outlet 313 of the exhaust conduit 322 and the distal end 354 abuts an arched wall 311. In such an arrangement, the cartridge component 305 and the volute component 350 form a volute that can receive exhaust via the conduit 322 and provide exhaust to a turbine wheel space via the throats of the vanes 334.

Figure 6:
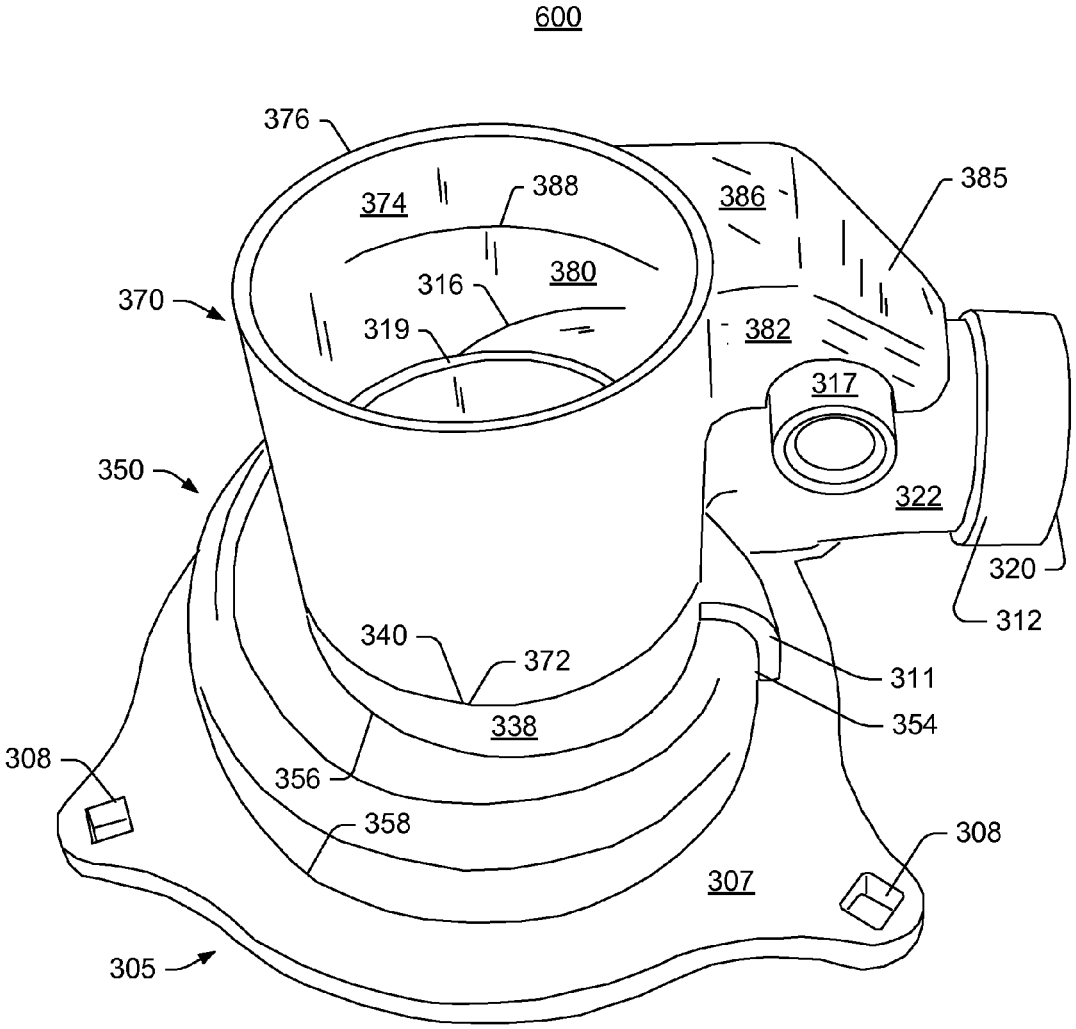
FIG. 6 is a perspective view of an assembly that includes the cartridge component, the volute component and the wastegate outlet component of FIG. 3.
Figure 8:
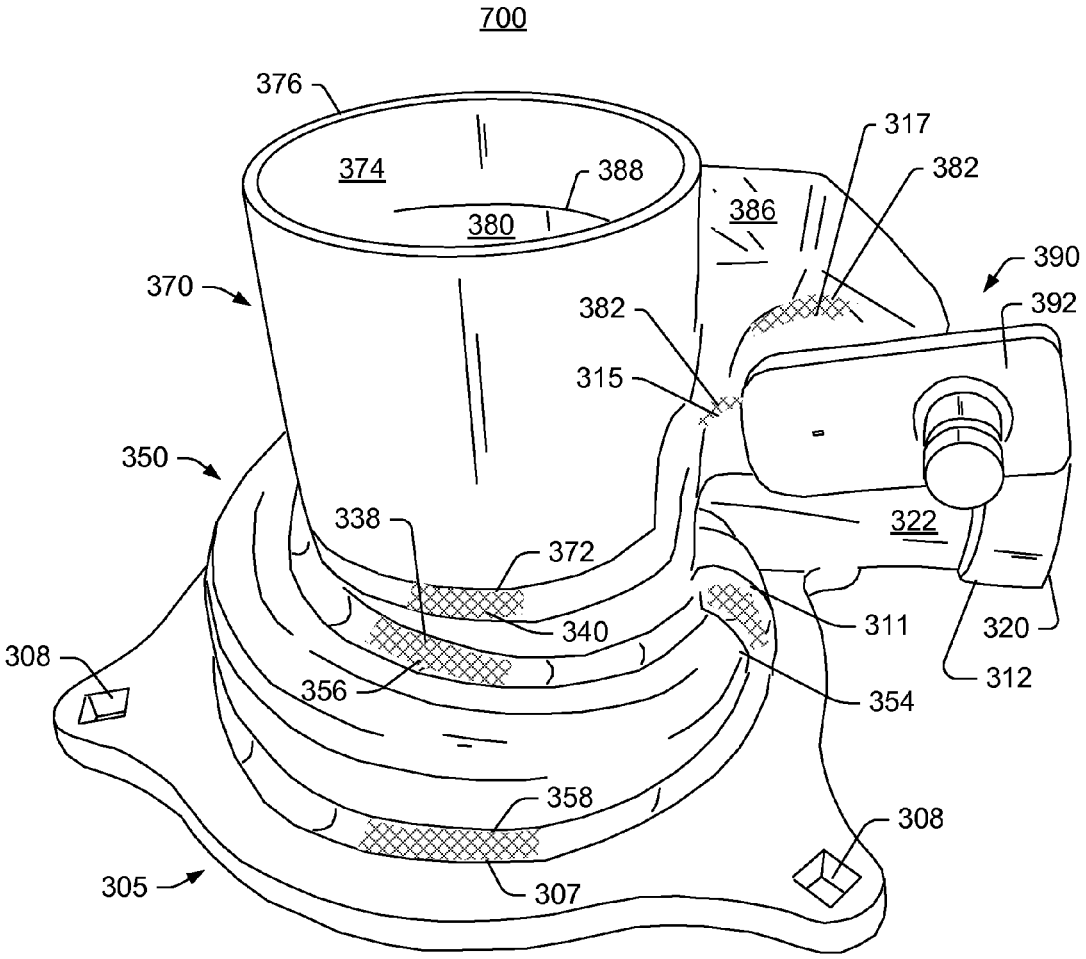
Figure 11:
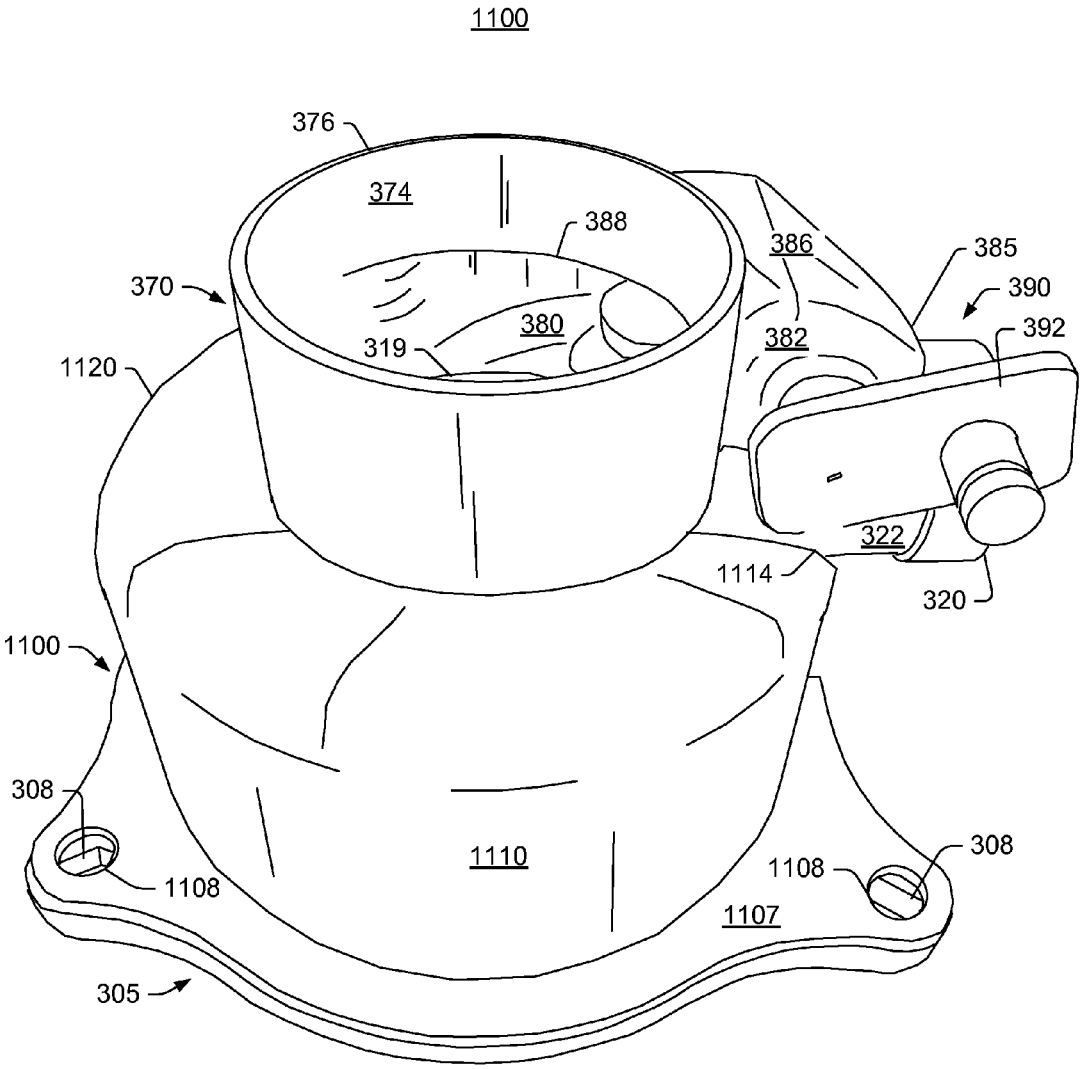
FIG. 11 is a perspective view of an assembly that includes the cartridge component, the volute component and the wastegate outlet component of FIG. 3 and another example of a burst shield.

In the example of FIG. 3, the wastegate outlet component 370 is configured with a cylindrical wall 374 that extends between and defines an inlet 372 and an outlet 376 as well as side walls 382 and 384 and an upper wall 386 that extend from the cylindrical wall 374 and an end wall 385, which collectively form in conjunction with the arcuate wall 319 and the planar surface 326 of the cartridge component 305, a wastegate chamber 380 (see, e.g., FIGS. 6, 8 and 11). The cylindrical wall 374 has an edge 388 associated with the upper wall 386 defines, in part, an outlet for the wastegate chamber 380.

The wastegate outlet component 370 may be seated with respect to the cartridge component 305 such that the outlet 340 of the cartridge component 305 provides for flow of exhaust to the inlet 372 of the wastegate outlet component 370. As mentioned, the walls 382, 384, 385 and 386 are seated with respect to the planar surface 326 and the arcuate wall 319 of the cartridge component 305 to form the wastegate chamber 380 where an opening is formed between the arcuate wall 319 and the edge 388 of the wastegate outlet component 370, the opening configured for receipt of exhaust from the chamber 380 (e.g., upon opening of the exhaust opening 328).

As shown in FIG. 3, the outlet component 370 functions as an extension of the cylindrical wall 338 of the cartridge component 305 as well as a cover (e.g., sides 382, 384, 385 and 386) that defines, in part, the wastegate chamber 380. As described herein, axial dimensions of the cylindrical wall 338 and the arcuate wall 319 may be minimized to reduce weight yet be sufficient to provide integrity, form an ample shroud for a turbine wheel, etc. The outlet component 370 may be made from a material that differs from that of the cartridge component 305.

As described herein, an assembly can include a cast cartridge component that includes a base plate having an opening configured for receipt of a turbine wheel, a cylindrical wall that includes a shroud portion, one or more supports disposed between the cylindrical wall and the base plate, an exhaust conduit that includes an inlet, an outlet and a wastegate opening positioned intermediate the inlet and the outlet, and a substantially planar surface integral to the exhaust conduit, the wastegate opening located on the planar surface; and a wastegate outlet component that includes a cylindrical portion that extends between and defines an inlet and an outlet, and a cover portion configured to cover the substantially planar surface of the cast cartridge component to form a wastegate chamber where one or more openings provide for flow of exhaust from the wastegate chamber to the cylindrical portion.

In the foregoing example, the cartridge component can include at least one of the one or more openings that provide for flow of exhaust from the wastegate chamber to the cylindrical portion of the wastegate outlet component. In such an example, an arcuate wall (e.g., the wall 319) can define, at least in part, at least one of the one or more openings that provide for flow of exhaust form the wastegate chamber to the cylindrical portion of the wastegate outlet component. Where a wall of the cartridge component 305 extends to, for example, the edge 388, the wall can include notches, apertures or other features to form one or more openings. In various examples, an edge of a cover portion can define, at least in part, at least one of the one or more openings that provide for flow of exhaust form the wastegate chamber to the cylindrical portion of the wastegate outlet component. Accordingly, as described herein, an arcuate wall and an edge of a wastegate outlet portion can define one or more openings that provide for flow of exhaust from a wastegate chamber to a cylindrical portion of a wastegate outlet component.

While various examples include a cartridge component defining one or more openings for flow from a wastegate chamber, a wastegate outlet component can include at least one of the one or more openings that provide for flow of exhaust from a wastegate chamber to a cylindrical portion.

As shown in various examples, a cartridge component can include a rib that extends axially from the exhaust conduit and that defines an edge of a planar surface that forms part of a chamber and an arcuate wall that extends axially from a cylindrical wall and that defines an edge of the planar surface. As described herein, a cartridge component can include a rib that extends from an exhaust conduit where the rib is configured to support a wastegate valve control mechanism.

As described herein, an assembly can further include a curved wall with a proximal end and a distal end, and an upper edge and a lower edge where joinder of the proximal end and an outlet of an exhaust conduit, joinder of the upper edge and a cylindrical wall and joinder of the lower edge and a base plate forms a volute configured to direct exhaust received via an inlet of the exhaust conduit to a turbine wheel via one or more openings disposed between the cylindrical wall and the base plate. In the foregoing example, the curved wall can have a shape that corresponds to a specific turbine wheel. Further such a curved wall may be selected from multiple curved walls having different shapes.

As shown in various examples, an exhaust conduit has an axis oriented substantially parallel to a plane defined by a base plate and a cylindrical wall has an axis oriented substantially perpendicular to a plane defined by the base plate. The cartridge component can include a socket configured for joinder with a distal end of a curved wall where the socket is optionally integral with an exhaust conduit.

As described herein, one or more supports can define one or more openings disposed between a cylindrical wall and a base plate. In various examples, at least one of the one or more supports can be a vane. For example, all of the supports can be vanes where adjacent vanes define throats to direct exhaust to a turbine wheel space defined by the cast cartridge component.

Figure 4:
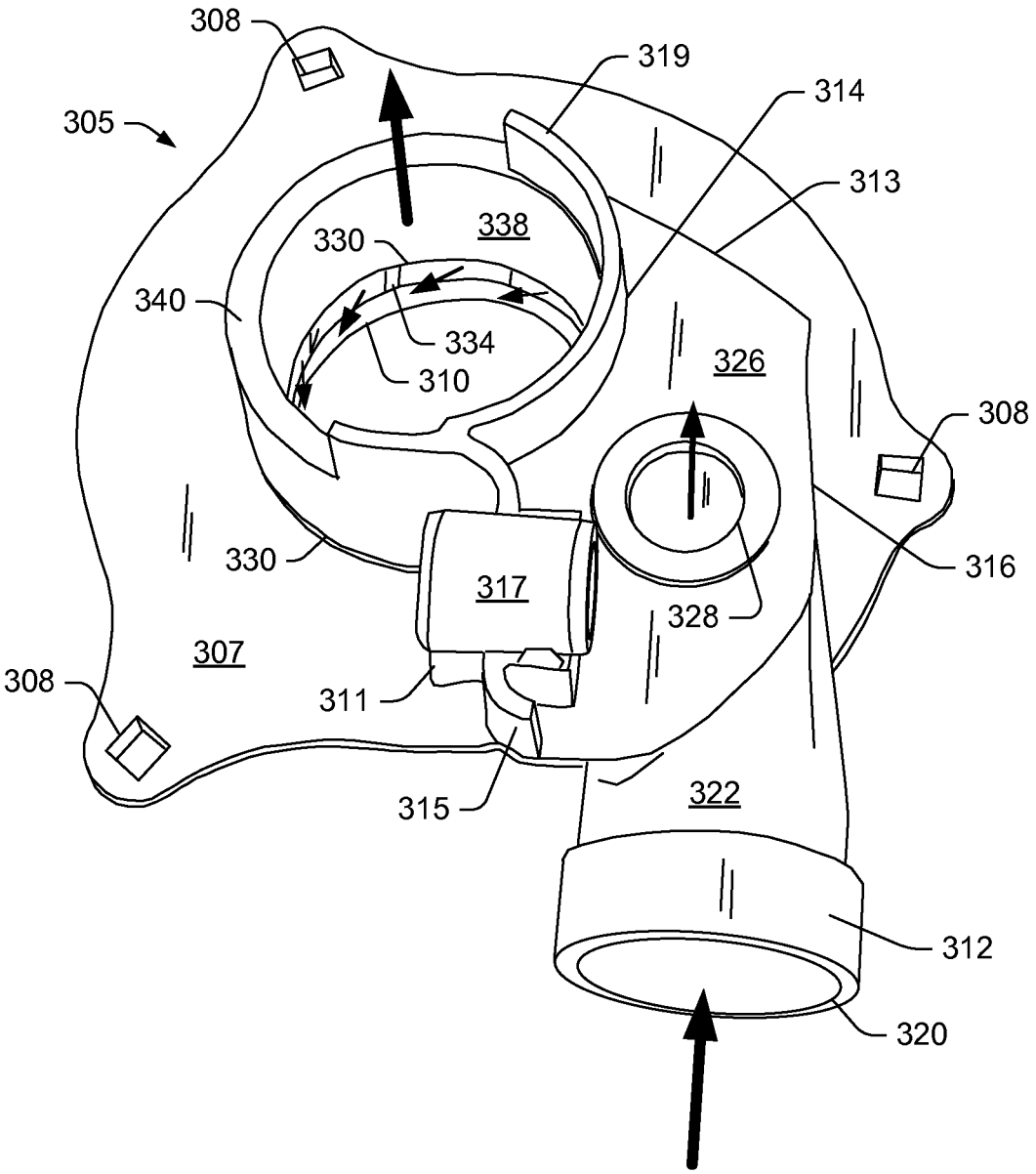
FIG. 4 is a perspective view of the cartridge component of FIG. 3.

FIG. 4 shows a perspective view of the cartridge component 305 of FIG. 3. In FIG. 4, the planar surface 326 is shown as including an edge 314 that meets the rib 315 and the wall 319 as well as the outlet 313 and an edge 316 that extends from the outlet 313 to the rib 315. In the example of FIG. 4, the planar surface 326 is cast integral to the exhaust conduit 322 and includes the wastegate opening 328. While the surface 326 in FIG. 4 is substantially planar, in other examples it may have a different shape yet still define, in part, a wastegate chamber such as the chamber 380.

In operation, a wastegate valve regulates flow of exhaust from the exhaust conduit 322 through the wastegate opening 328 and into the chamber 380 (e.g., as regulated by a regulator, which may optionally include a processor and processor-executable instructions). Exhaust exits the chamber 380 via an opening defined by the upper end of the arcuate wall 319 and an edge 388 of the wastegate outlet component 370. Exhaust flowing through the wastegate opening 328 bypasses the volute formed by the cartridge component 305 and the volute component 350 and hence does not contribute to rotation of a turbine wheel received by the opening 310 of the base plate 307 of the cartridge component 305.

As mentioned, the cartridge component 305 may be cast and have rigidity sufficient to mount or clamp other components of a turbocharger (e.g., a bearing housing). Further, the size of various features of the cartridge component 305 may be minimized to conserve mass yet still provide sufficient rigidity to receive other components.

While not shown, a volute component and a wastegate outlet component may be formed integrally or first connected and attached to a cartridge component. In such an example, the cartridge component still serves as a rigid component for receipt of the component or components that include the volute and wastegate outlet features. In another example, an arcuate wall may include one or more openings for exhaust to exit an exhaust wastegate chamber. In such an example, a cover component may be configured to meet the top edge of the wall. Various other configurations are possible where, at least, an exhaust wastegate chamber is formed that includes an exit for exhaust received via an opening in an exhaust conduit. Further, while the examples of FIGS. 3 and 4 show the fixture 317 as a cylinder with a bore, in other examples, a control mechanism for the opening 328 may be configured differently yet still allow for regulation of exhaust from an exhaust conduit to an exhaust wastegate chamber (e.g., via an ECU or other regulation device).

Figure 5:
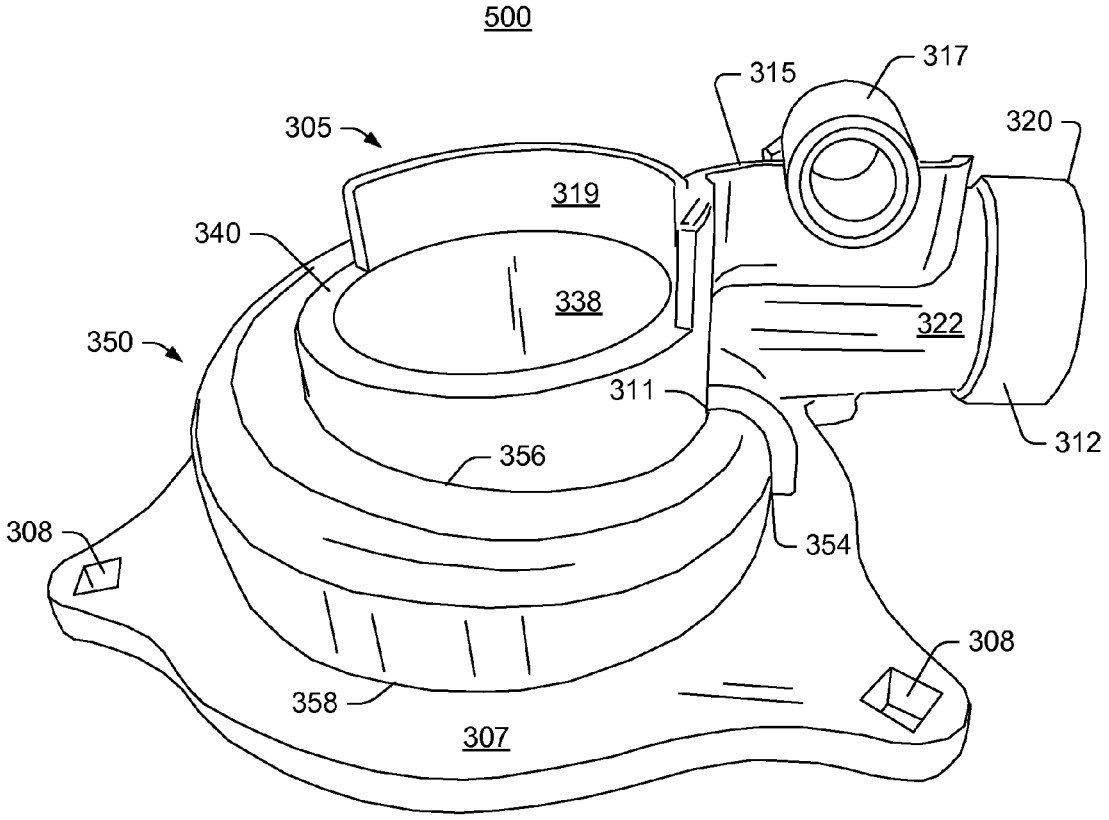
FIG. 5 is a perspective view of an assembly that includes the cartridge component and the volute component of FIG. 3.

FIG. 5 shows a perspective view of an assembly 500 that includes the cartridge component 305 and the volute component 350. In FIG. 5, the arched wall 311 defines an opening for receipt of the distal end 354 of the volute component 350. As shown, the rib 315 has an axial height approximately the same as the arcuate wall 319. As mentioned, the rib 315 and the arcuate wall 319 are configured to cooperate with the wastegate outlet component 370. The side 382 of the wastegate outlet component 370 may include a cut-out portion that conforms to the shape of the fixture 317 supported by the rib 315. For example, the side 382 may include an arcuate cut-out to match the shape of the cylindrical fixture 317.

FIG. 6 shows a perspective view of an assembly 600 that includes the cartridge component 305, the volute component 350 and the wastegate outlet component 370. In FIG. 6, these components are positioned (e.g., assembled with appropriate alignment) and ready for joinder. Per the alignment of components in FIG. 6, joints exist between the base plate 307 and the lower edge 358 of the volute component 350, between the outlet 313 of the conduit 322 and the end 352 of the volute component 350, between the upper edge 356 of the volute component 350 and the cylindrical wall 338, between the inlet 372 of the wastegate outlet component 370 and the outlet 340 of the cylindrical wall 338, between the planar surface 326 of the cartridge component 305 and the side 384 of the wastegate outlet component 370 (see, e.g., edge 316) as well as between the planar surface 326 and the side 385, between the rib 315 and the side 382, between the fixture 317 and the side 382, and between the end 354 of the volute component 350 and the arched wall 311 of the cartridge component 305.

FIG. 6 shows the chamber 380 as well as the arcuate wall 319 where the wall 319 of the cartridge component 305 and the edge 388 of the wastegate outlet component 370 define an opening for flow of exhaust from the chamber 380 to the cylindrical portion of the wastegate outlet component 370.

As described herein, various components may be joined by any of a variety of techniques. For example, chemical, mechanical or thermal techniques may be used to join and seal various components.

Figure 7:
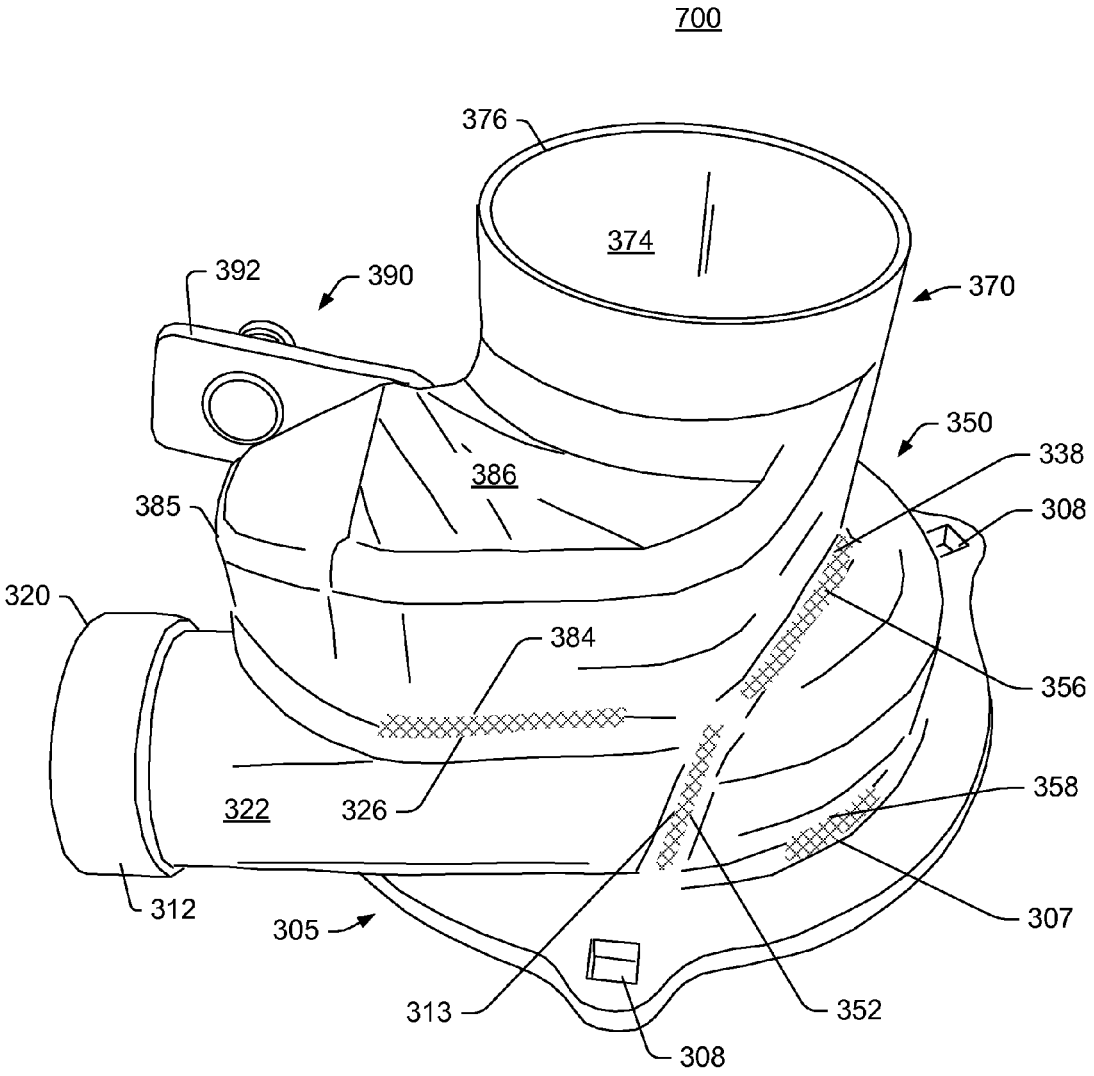
FIGS. 7 and 8 are perspective views of an assembly that includes the cartridge component, the volute component and the wastegate outlet component of FIG. 3.

FIGS. 7 and 8 show perspective views of an assembly 700 that includes the cartridge component 305, the volute component 350 and the wastegate outlet component 370 as well as a control valve mechanism 390 for control of the wastegate opening 328 where the control valve mechanism 390 includes a control arm 392.

In FIGS. 7 and 8, hatched lines indicate joinder of the various components via welds that exist between the base plate 307 and the lower edge 358 of the volute component 350, between the outlet 313 of the conduit 322 and the end 352 of the volute component 350, between the upper edge 356 of the volute component 350 and the cylindrical wall 338, between the inlet 372 of the wastegate outlet component 370 and the outlet 340 of the cylindrical wall 338, between the planar surface 326 of the cartridge component 305 and the side 384 of the wastegate outlet component 370 as well as between the planar surface 326 and the side 385, between the rib 315 and the side 382, between the fixture 317 and the side 382, and between the end 354 of the volute component 350 and the arched wall 311 of the cartridge component 305. Welds may be made via any of a variety of processes (thermal, chemical, etc.), which may depend on materials of construction of the various components. Depending on configuration, other types of joinder may be employed (e.g., where risk of exhaust leakage is acceptably minimized).

Figure 9:
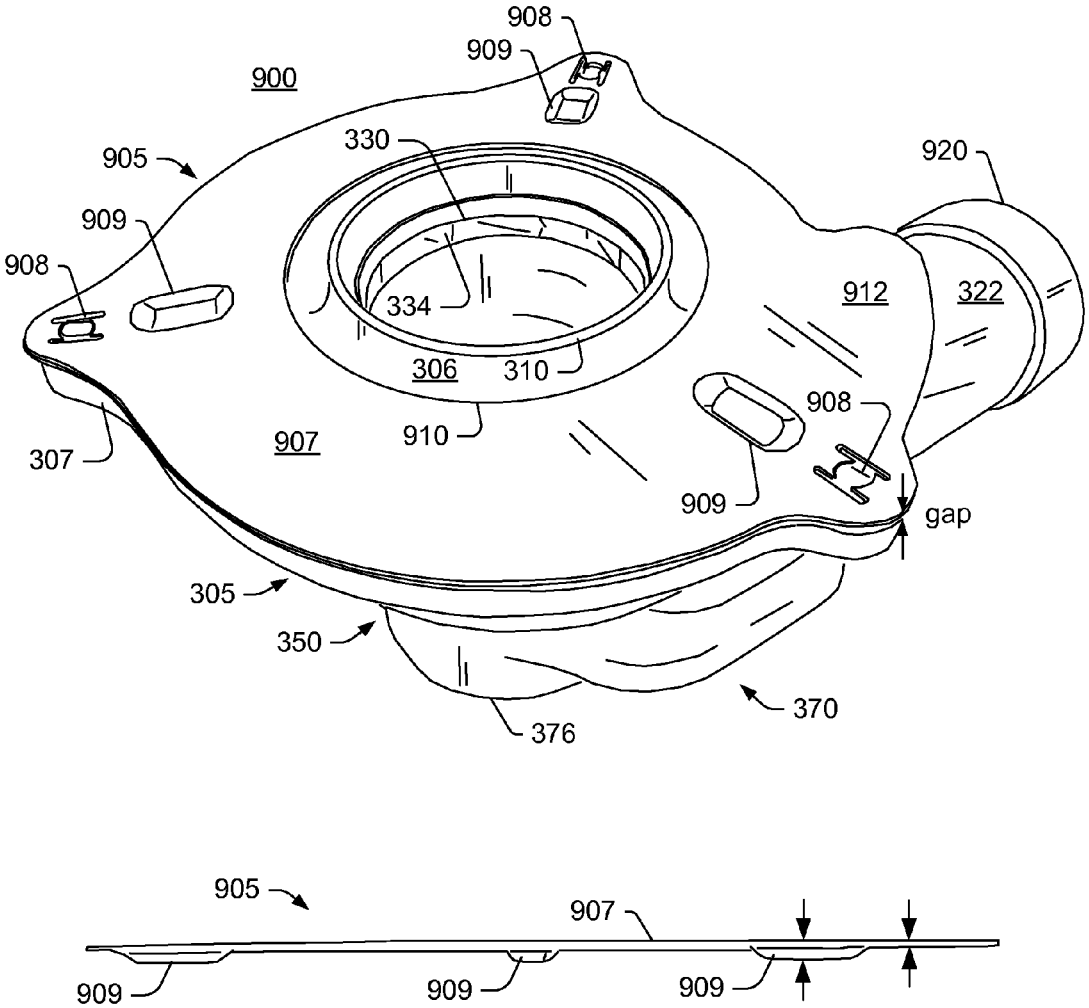
FIG. 9 is a perspective view of an assembly that includes an example of a heat shield as well as a side view of the heat shield.

FIG. 9 shows a perspective view of an assembly 900 that includes a heat shield 905 as well as a side view of the heat shield 905. Such a heat shield can shield components from thermal radiation emitted by a turbine during and after operation (e.g., during cool down). In the example of FIG. 9, the heat shield 905 includes fixation openings 908, spacers 909, a central opening 910 as well as a tongue 912 that extends in a direction along the axis of the conduit 322. FIG. 9 also shows a lip 306 that surrounds the opening 310 of the cartridge component 305.

In the example of FIG. 9, the spacers 909 may be stamped or otherwise formed in a flat piece of material (e.g., metal, composite material, etc.). The spacers 909 ensure that a substantially flat portion 907 of heat shield 905 is maintained a distance from the base component 305, for example, to provide a space for air. Addition of the shield 900 does not require any additional fasteners, for example, as shown in the assembly of FIG. 12.

Figure 10:
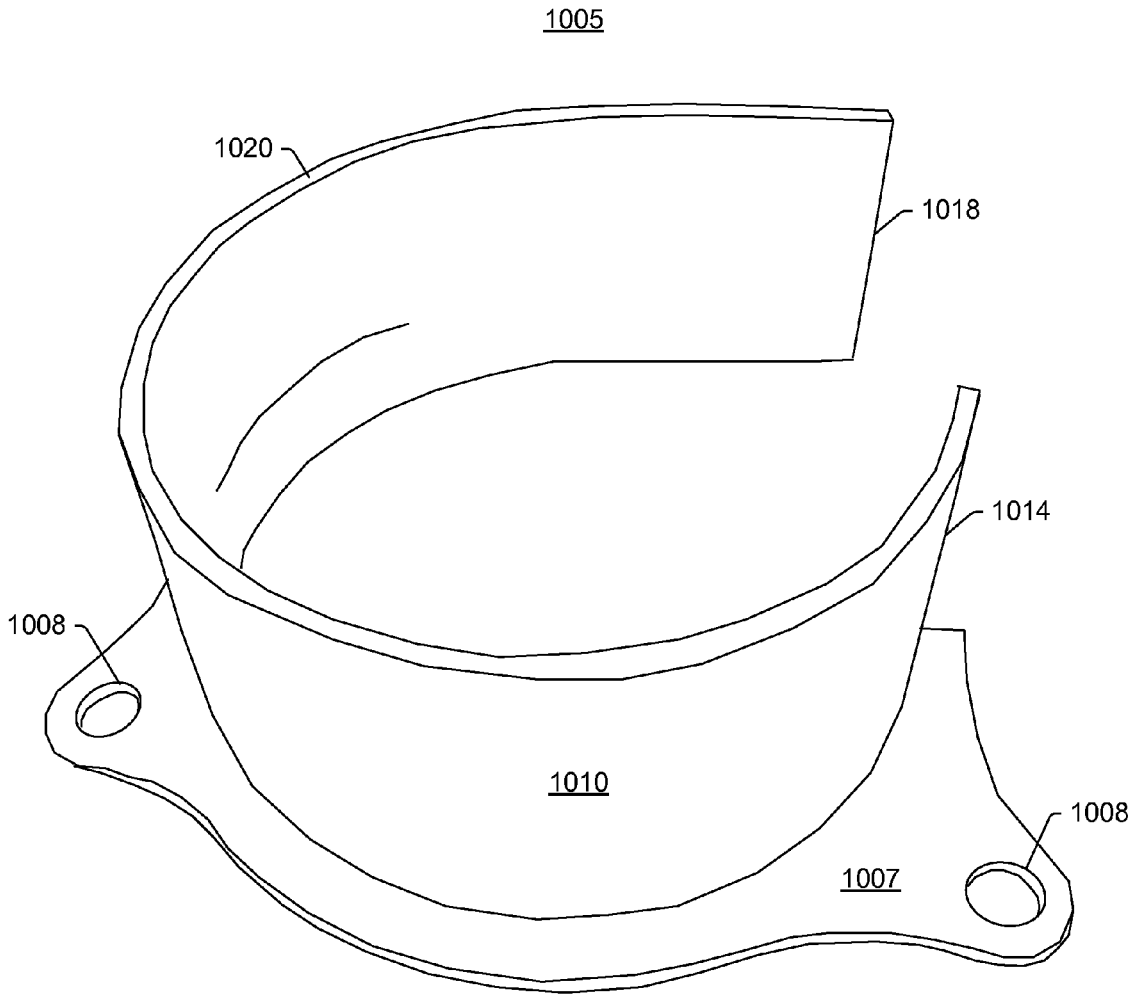
FIG. 10 is a perspective view of an example of a burst shield.

FIG. 10 shows an example of a burst shield 1005. The burst shield 1005 includes a base 1007 and a wall 1010 having ends 1014 and 1018 and an upper edge 1020. The base 1007 includes openings 1008 for mounting to a turbine housing assembly. The ends 1014 and 1018 define a gap, for example, of sufficient width to accommodate a conduit and optionally features of a wastegate control mechanism of a turbine housing assembly.

FIG. 11 shows a perspective view of an assembly 1100 that includes the cartridge component 305, the volute component 350, the wastegate outlet component 370, the wastegate control mechanism 390 with control arm 392 and a burst shield 1105. The burst shield 1105 has features similar to the burst shield of FIG. 10 but further includes a cover portion 1120. The cover 1120 and the surrounding wall 1110 present barriers to debris in the instance a burst occurs. These features also act as barriers to heat transfer, which can diminish radiation and shorten warm up times of a turbine assembly. Diminishing radiation can be important to reduce impact on surrounding components, for example, electrical components that may be sensitive to external radiation. As shown in FIG. 11, openings 1108 of the burst shield 1105 align with the openings 308 of the base plate 307 of the cartridge component 305. Further, the burst shield 1105 is configured such that the ends 1114 and 1118 provide clearance for the conduit 322 of the cartridge component 305 and the control arm 392 of the control mechanism 390.

Figure 12:
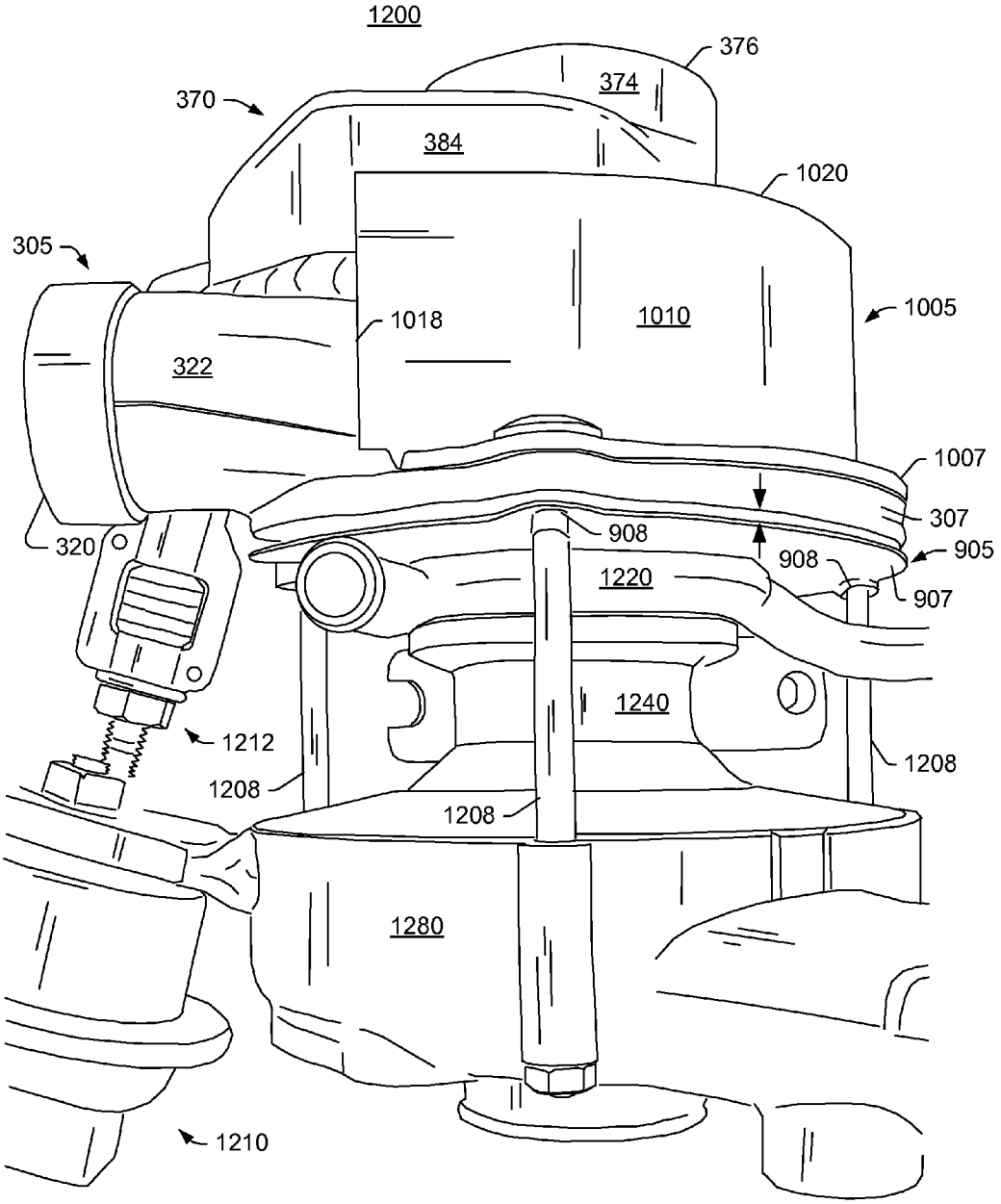
FIG. 12 is a perspective view of an example of an assembly that includes some of the components of the assembly of FIG. 11.

FIG. 12 shows a perspective view of an assembly 1200 that includes some components of the assembly of FIG. 11, the heat shield 905 of FIG. 9, a wastegate actuator 1210 to operate the control arm 392 of the control mechanism 390, a fluid conduit 1220, a bearing housing 1240 and a compressor assembly 1280. In the example of FIG. 12, rods 1208 extend from the burst shield 1005 to the compressor assembly 1280 and clamp the bearing housing 1240. The cartridge component 305 provides structural rigidity and integrity to support clamping of the bearing housing 1240 between a turbine and a compressor. The heat shield 905 allows for the fluid conduit 1220 to be mounted without directly contacting the cartridge component 305. The fluid conduit 1220 can allow for flow of a cooling fluid to remove heat from the assembly 1200, particularly heat transferred to the heat shield 905.

As shown in the example of FIG. 12, the wastegate actuator 1210 may be attached, in part, to the compressor assembly 1280. A detachment mechanism 1212 may allow for disassembly of some components of the actuator 1210 such that the rods 1208 may be removed and the turbine assembly and other pieces taken apart without detaching the wastegate actuator 1210 from the compressor assembly 1280.

Figure 13:
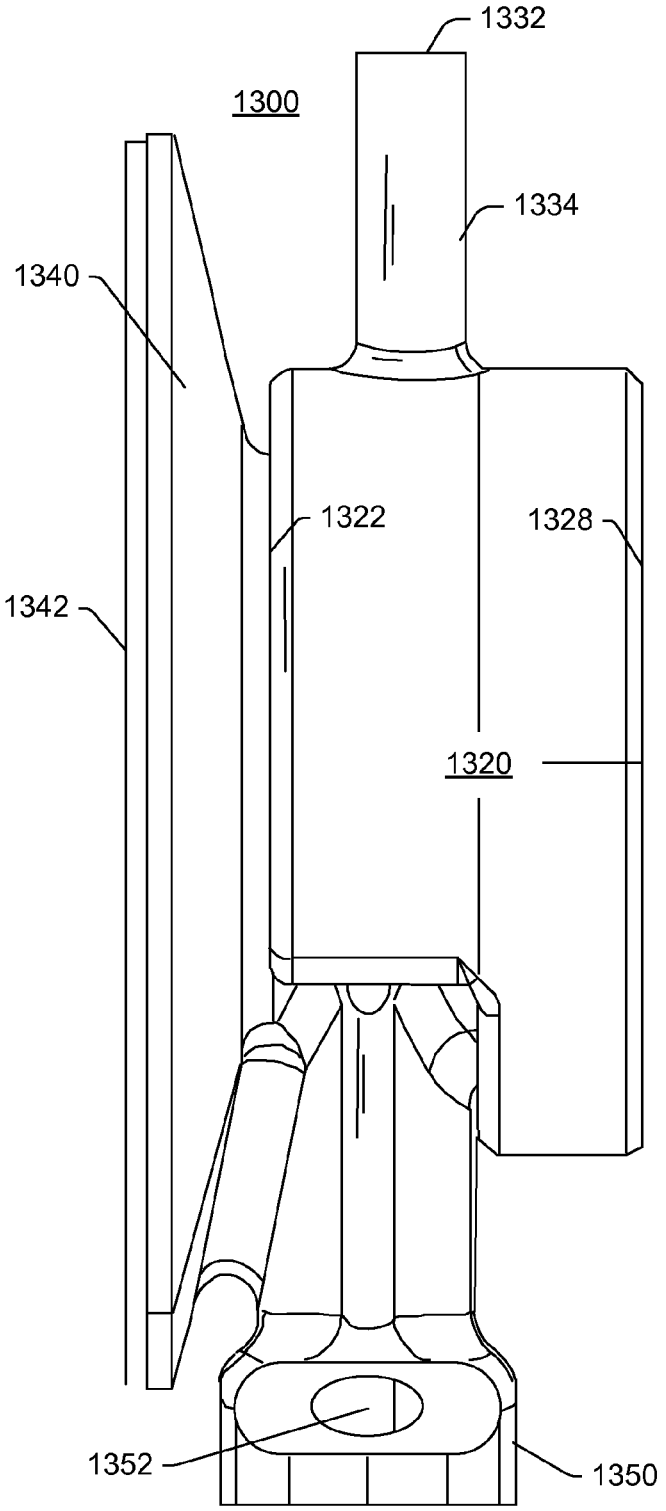
FIG. 13 is a side view of an example of a center housing and fluid jacket assembly.

FIG. 13 shows an example of a center housing and fluid jacket assembly 1300. The center housing 1340 includes a compressor end 1342 and a base 1350 with a fixation feature 1352, for example, to fix a turbocharger to an engine assembly. The fluid jacket 1320 includes a compressor end 1322 and a turbine end 1328. In the view of FIG. 13, an opening 1332 is shown as associated with a conduit 1334. A U.S. patent application entitled "Turbocharger bearing housing assembly", having Ser. No. 12/838,317 and filed Jul. 16, 2010 describes details of various housing and fluid jacket assemblies and is incorporated herein by reference.

Figure 14:
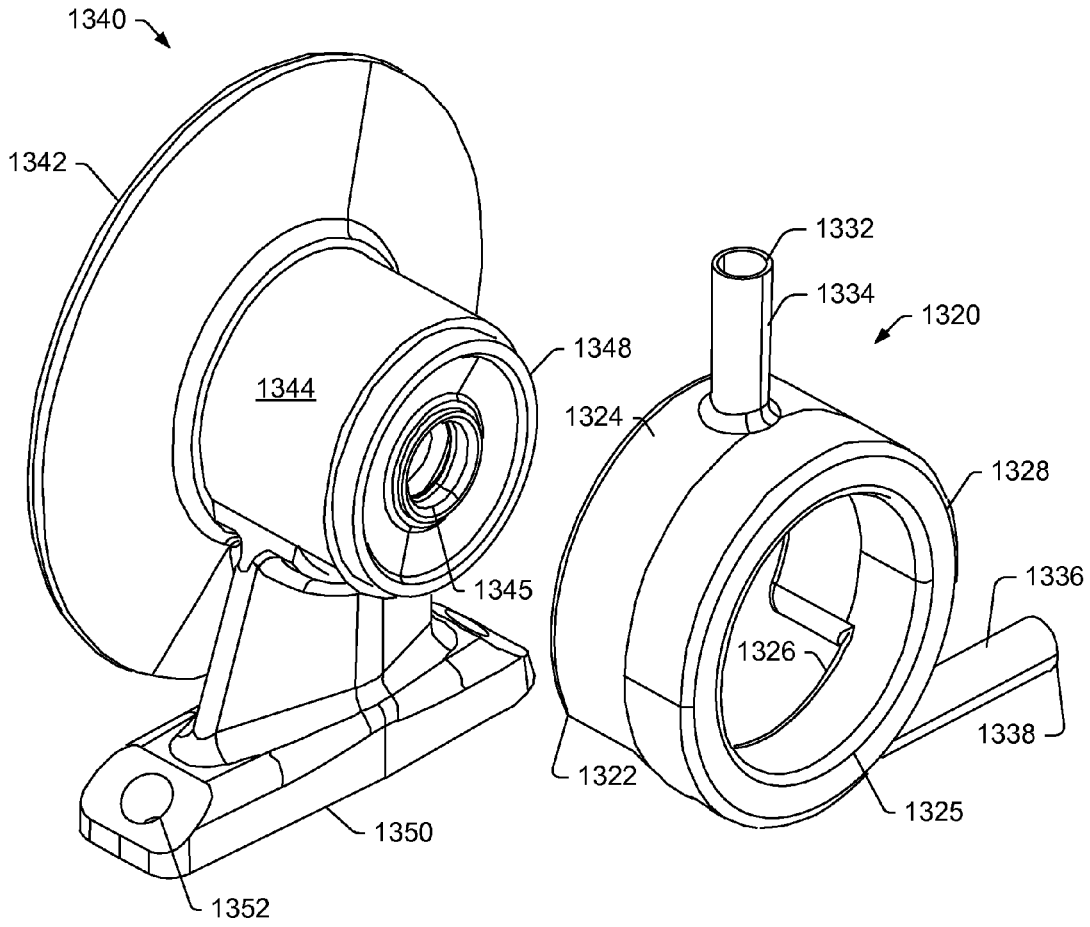
FIG. 14 is a perspective view of the center housing and the fluid jacket of FIG. 13.

FIG. 14 shows the center housing 1340 and fluid jacket 1320 of the assembly 1300 of FIG. 13. The center housing 1340 includes the compressor end and a turbine end 1348 and, positioned between these two ends, a bearing housing portion 1344 with a bore 1345 configured for receipt of a bearing system (e.g., one or more bearings and a shaft). As described herein, the center housing 1340 can be configured for attachment to the cartridge component 305, optionally with the fluid jacket 1320 or the heat shield 905 or both the fluid jacket 1320 and the heat shield 905.

In the example of FIG. 14, the fluid jacket 1320 includes a central portion 1324 located between the compressor end 1322 and the turbine end 1328 where a bore 1325 exists together with a cut-out portion 1326 configured for positioning the fluid jacket 1320 with respect to the center housing 1340. Another conduit 1336 is also show with an opening 1338. The openings 1332 and 1338 may be an inlet and an outlet or an outlet and an inlet, depending on direction of fluid flow to and from the fluid jacket 1320.

Figure 15:
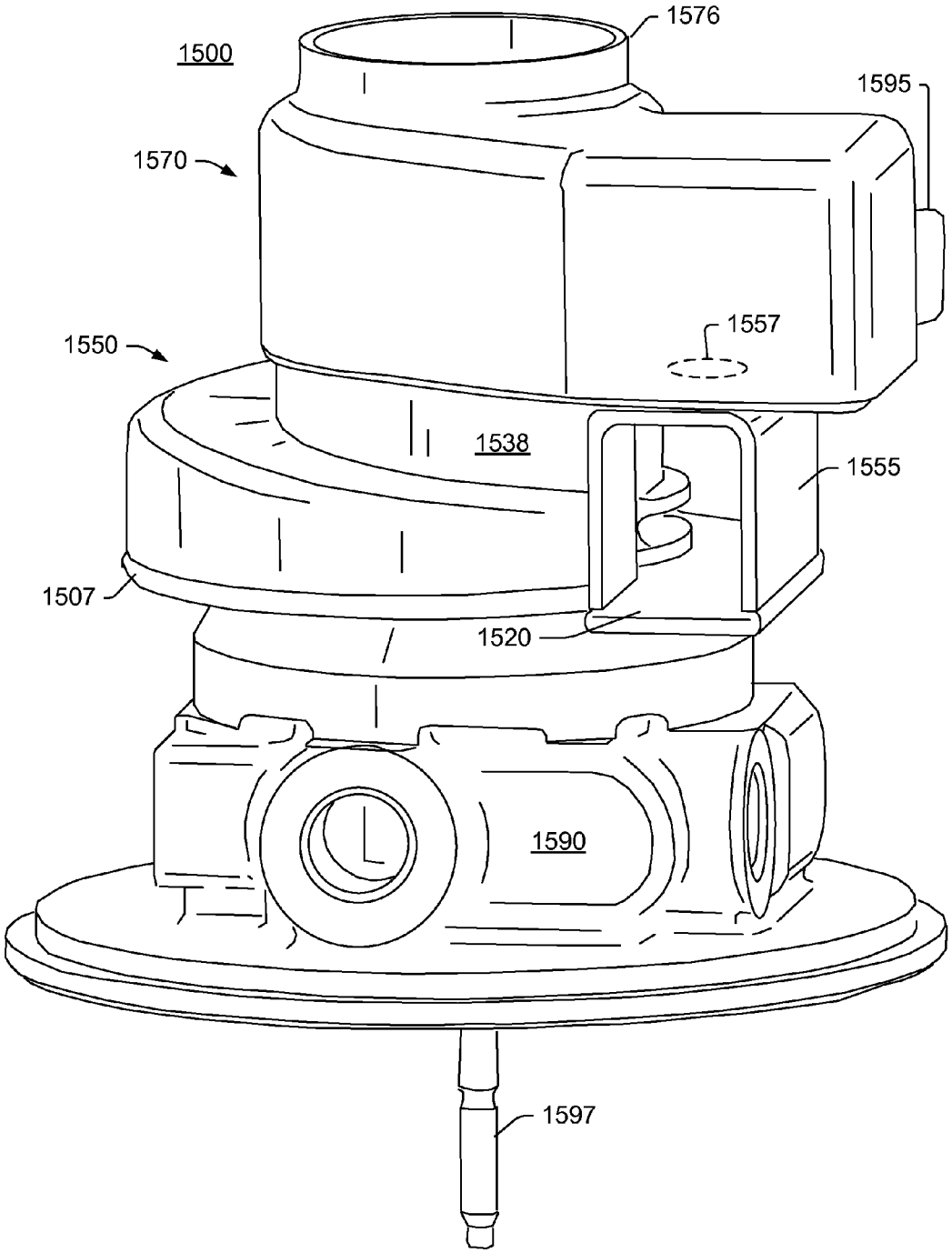
FIG. 15 is a perspective view of an example of a turbine assembly with a wastegate mounted to a center housing.

FIG. 15 shows an example of an assembly 1500 that includes a turbine assembly with a wastegate mounted to a center housing 1590 that supports a shaft 1597. In the example of FIG. 15, the turbine assembly includes a base portion 1507, a cylindrical portion 1538 and a volute wall 1550 that has at one end an opening portion 1555 that forms an opening 1520 (e.g., an inlet for exhaust). The opening portion 1555 that may be configured as a fixture for attachment to an exhaust conduit. Hence, in this example, the fixture or fitting for an exhaust conduit is formed as part of the volute wall 1550 in contrast to some other examples where a cast portion forms a fixture of fitting. In the example of FIG. 15, the volute wall 1550 includes a wastegate opening 1557 that allows exhaust gas to bypass a turbine wheel mounted in the housing and to ultimately exit via the opening 1576. The wastegate component 1570 includes a control arm 1595 for actuation of a wastegate valve disposed in the assembly 1500 that allows for control of exhaust flow via the wastegate opening 1557 of the volute wall 1550.

As described herein, an assembly can include a cast cartridge component that includes a base plate having an opening configured for receipt of a turbine wheel, a cylindrical wall that includes a shroud portion, and one or more supports disposed between the cylindrical wall and the base plate; a curved wall component that includes a proximal end and a distal end, a wastegate opening disposed between the proximal end and the distal end, and an upper edge and a lower edge, where the proximal end of the curved wall forms an inlet for exhaust and where joinder of the upper edge and the cylindrical wall and joinder of the lower edge and the base plate forms a volute configured to direct exhaust received via the inlet to a turbine wheel via the throats; and a wastegate outlet component that includes a cylindrical portion that extends between and defines an inlet and an outlet, and a cover portion configured to cover a portion of the curved wall, the portion having the wastegate opening, to form a wastegate chamber where one or more openings provide for flow of exhaust from the wastegate chamber to the cylindrical portion.

Figure 16:
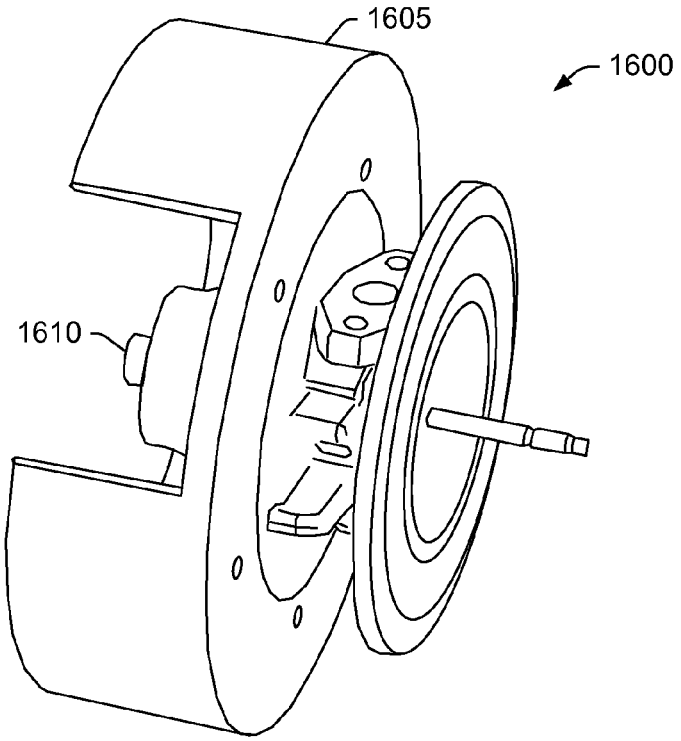
FIG. 16 is a perspective view and a cross-sectional view of an example of a center housing with a burst shield.
Figure 16:
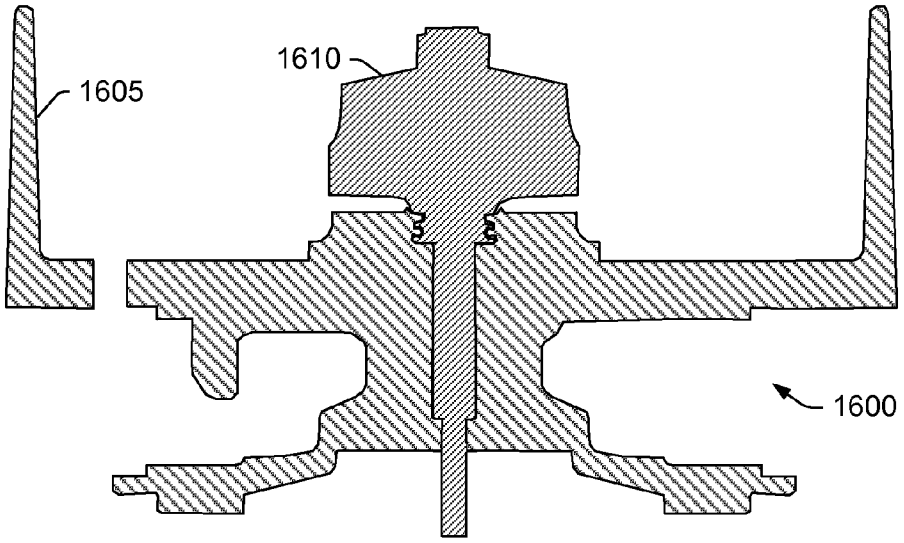

FIG. 16 shows an as center housing 1600 that includes an integral burst shield 1605. The housing 1600 may be cast and of sufficient integrity to impede debris in the instance of a burst turbine wheel 1610. The shield 1605 has a cylindrical shape with a cutout portion to accommodate an exhaust inlet for a volute. A turbine housing may be mounted onto the center housing 1600. As shown in the example of FIG. 16, the shield 1605 rises to at least the height of an exducer portion of the turbine wheel 1610.

Figure 17:
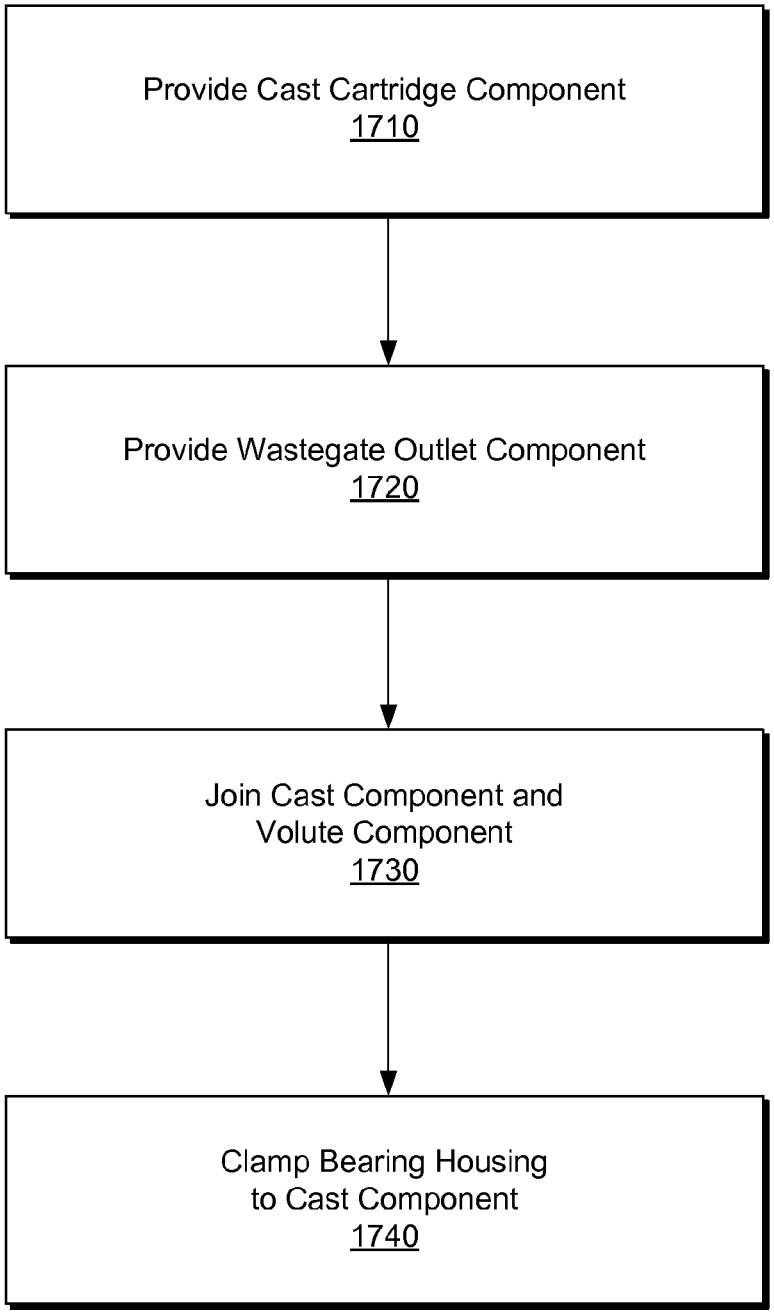
FIG. 17 is a diagram of a method for assembling turbocharger components.

FIG. 17 shows a block diagram of a method 1700 for assembling turbocharger components. The method 1700 includes providing a cast cartridge component 1710 and providing a wastegate outlet component 1720. A join block 1730 includes joining the cast cartridge component and the wastegate outlet component. A clamp block 1740 includes clamping a bearing housing to the cast cartridge component.

With respect to the cast cartridge component and the wastegate outlet component, these components may include features of the components 305 and 370 as well as component 350 of FIG. 3. The join block 1730 optionally includes welding the wastegate outlet component to the cast cartridge component, which forms a wastegate chamber. The clamp block 1740 optionally includes clamping the bearing housing between the cast cartridge component and a compressor housing using, for example, rods that extend between the cast cartridge component and the compressor housing without contacting the bearing housing. Such an approach can reduce heat transfer between a turbine housing and a bearing housing. Further, such an approach can allow for enhance air flow to a bearing housing, which can enhance heat transfer from a bearing housing.

The method 1700 optionally includes mounting a heat shield to the cast cartridge prior to the clamping. The method 1700 optionally includes mounting a burst shield to the cast cartridge component prior to the clamping. The method 1700 optionally includes mounting a heat shield and mounting a burst shield to the cast cartridge component prior to the clamping. As described herein, clamping may help secure a heat shield, a burst shield or both a heat shield and a burst shield, for example, as shown in the assembly 1200 of FIG. 12. The bearing housing may be the center housing 1340 optionally with the fluid jacket 1320 of FIGS. 13 and 14.

Although some examples of methods, devices, assemblies, systems, arrangements, etc., have been illustrated in the accompanying Drawings and described in the foregoing Detailed Description, it will be understood that the example embodiments disclosed are not limiting, but are capable of numerous rearrangements, modifications and substitutions without departing from the spirit set forth and defined by the following claims.

What is claimed is:

1. An assembly comprising:

a cast cartridge component that comprises a base plate having an opening configured for receipt of a turbine wheel, a cylindrical wall that comprises a shroud portion, one or more supports disposed between the cylindrical wall and the base plate, an exhaust conduit that comprises an inlet, an outlet and a wastegate opening positioned intermediate the inlet and the outlet, and a planar surface integral to the exhaust conduit, the wastegate opening located on the planar surface; and a wastegate outlet component that comprises a cylindrical portion that extends between and defines an inlet and an outlet, and a cover portion configured to cover the substantially planar surface of the cast cartridge component to form a wastegate chamber wherein one or more openings provide for flow of exhaust from the wastegate chamber to the cylindrical portion.

2. The assembly of claim 1 wherein the cartridge component comprises at least one of the one or more openings that provide for flow of exhaust from the wastegate chamber to the cylindrical portion of the wastegate outlet component.

3. The assembly of claim 1 wherein the cartridge component comprises an arcuate wall that defines, at least in part, at least one of the one or more openings that provide for flow of exhaust from the wastegate chamber to the cylindrical portion of the wastegate outlet component.

4. The assembly of claim 3 wherein an edge of the cover portion defines, at least in part, at least one of the one or more openings that provide for flow of exhaust from the wastegate chamber to the cylindrical portion of the wastegate outlet component.

5. The assembly of claim 4 wherein an edge of the arcuate wall and the edge of the wastegate outlet portion define the one or more openings that provide for flow of exhaust from the wastegate chamber to the cylindrical portion of the wastegate outlet component.

6. The assembly of claim 1 wherein the wastegate outlet component comprises at least one of the one or more openings that provide for flow of exhaust from the wastegate chamber to the cylindrical portion.

7. The assembly of claim 1 further comprising a rib that extends axially from the exhaust conduit and that defines an edge of the planar surface and an arcuate wall that extends axially from the cylindrical wall and that defines an edge of the planar surface.

8. The assembly of claim 1 further comprising a rib that extends from the exhaust conduit and that supports a wastegate valve control mechanism.

9. The assembly of claim 1 further comprising a curved wall that comprises a proximal end and a distal end, and an upper edge and a lower edge wherein joinder of the proximal end and the outlet of the exhaust conduit, joinder of the upper edge and the cylindrical wall and joinder of the lower edge and the base plate forms a volute configured to direct exhaust received via the inlet to a turbine wheel via one or more openings disposed between the cylindrical wall and the base plate.

10. The assembly of claim 9 wherein the one or more supports define the one or more openings disposed between the cylindrical wall and the base plate.

11. The assembly of claim 9 wherein the curved wall comprises a shape that corresponds to a specific turbine wheel.

12. The assembly of claim 9 comprising multiple curved walls having different shapes, the curved wall for joinder to the cast component selected from the multiple curved walls.

13. The assembly of claim 1 wherein the base plate comprises openings, each opening configured to receive a rod to clamp a bearing housing between the base plate and a compressor.

14. The assembly of claim 1 wherein the exhaust conduit comprises an exhaust flow axis oriented parallel to a plane defined by the base plate.

15. The assembly of claim 1 wherein at least one of the one or more supports comprises a vane.

16. The assembly of claim 1 comprising vanes wherein adjacent vanes define throats to direct exhaust to a turbine wheel space defined by the cast cartridge component.

17. An assembly comprising:

a cast cartridge component that comprises a base plate having an opening configured for receipt of a turbine wheel, a cylindrical wall that comprises a shroud portion, and one or more supports disposed between the cylindrical wall and the base plate; wherein the one or more supports define one or more throats between the cylindrical wall and the base plate;

a curved wall component that comprises a proximal end and a distal end, a wastegate opening disposed between the proximal end and the distal end, and an upper edge and a lower edge, wherein the proximal end of the curved wall forms an inlet for exhaust and wherein joinder of the upper edge and the cylindrical wall and joinder of the lower edge and the base plate forms a volute to direct exhaust received via the inlet to a turbine wheel via the one or more throats; and a wastegate outlet component that comprises a cylindrical portion that extends between and defines an inlet and an outlet, and a cover portion to cover a portion of the curved wall, the portion having the wastegate opening, to form a wastegate chamber wherein one or more openings provide for flow of exhaust from the wastegate chamber to the cylindrical portion.

18. A method comprising:

providing a cast cartridge component that comprises a base plate having an opening for receipt of a turbine wheel, a cylindrical wall that comprises a shroud portion, one or more supports disposed between the cylindrical wall and the base plate, an exhaust conduit that comprises an inlet, an outlet and a wastegate opening positioned intermediate the inlet and the outlet, and a surface integral to the exhaust conduit, the wastegate opening located on the surface;

providing a wastegate outlet component;

joining the cast cartridge component and the wastegate outlet component to form a wastegate chamber; and clamping a bearing housing to the cast cartridge component.

19. The method of claim 18 wherein the joining comprises welding the wastegate outlet component to the cast cartridge component and wherein the clamping comprises clamping the bearing housing between the cast cartridge component and a compressor housing.

20. The method of claim 18 further comprising mounting a heat shield and mounting a burst shield to the cast cartridge component prior to the clamping wherein the clamping secures the burst shield.

* * * * *